United States Patent [19]

Scott

[11] 3,970,122

[45] July 20, 1976

[54] INFLATION DEVICE

[76] Inventor: Mark E. Scott, 616 Artwood Drive, Philadelphia, Pa. 19115

[22] Filed: July 17, 1974

[21] Appl. No.: 489,301

[52] U.S. Cl. ..... 141/349; 222/402.13; 251/347

[51] Int. Cl.[2] ..... B65B 3/04

[58] Field of Search ..... 141/38, 346–354, 141/360–362; 222/402.13; 251/291, 339, 347, 354

[56] References Cited

UNITED STATES PATENTS 3,329,180 7/1967 Brocklin ..... 141/349

*Primary Examiner*—Richard E. Aegerter
*Assistant Examiner*—Frederick R. Schmidt
*Attorney, Agent, or Firm*—Seidel, Gonda & Goldhammer

[57] ABSTRACT

A tubular nozzle housing having one end secured to a pressurized container supports a reciprocable actuator for selectively actuating a discharge valve on the container when the opposite end of the nozzle housing is threaded to means for receiving the pressured contents of said container.

7 Claims, 6 Drawing Figures

FIG.1
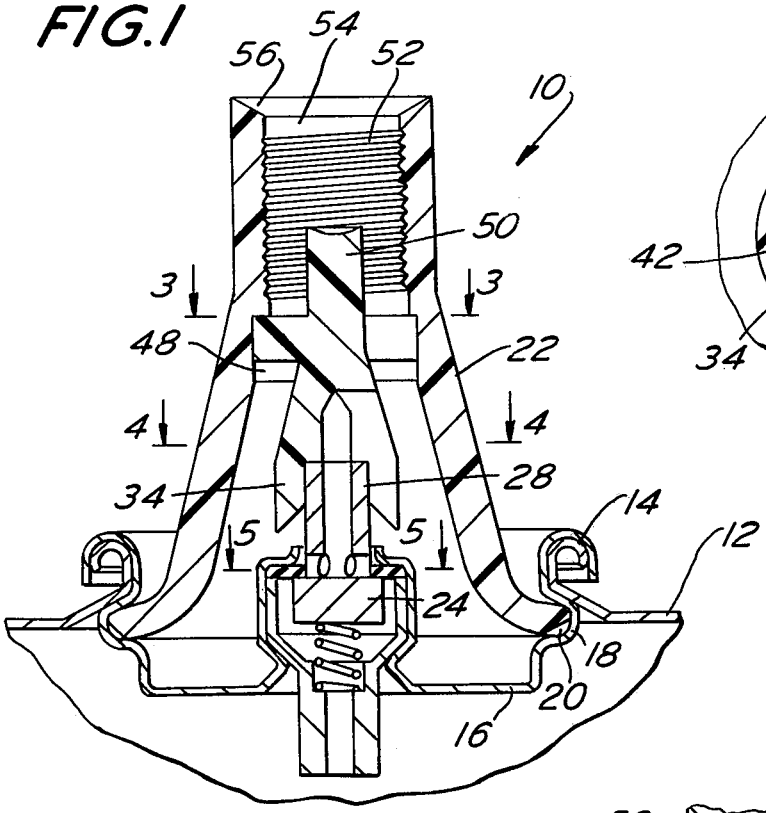
FIG.3
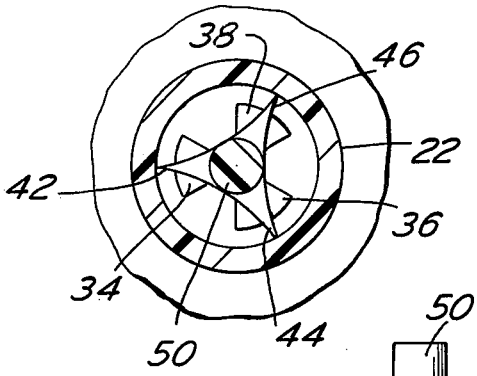
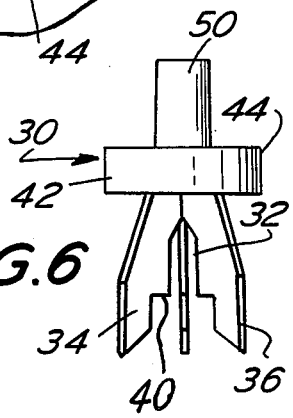
FIG.6
FIG.4
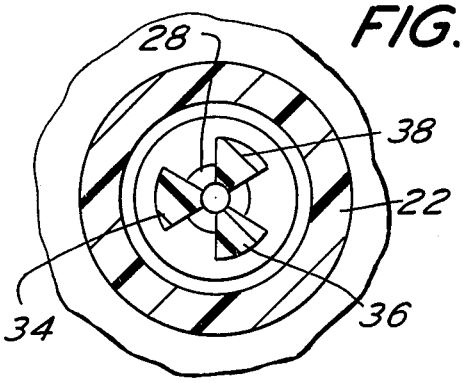
FIG.5
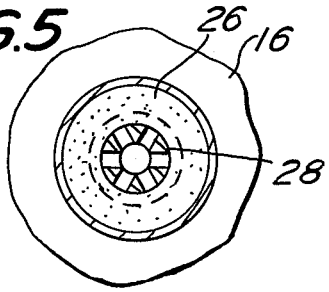
FIG.2
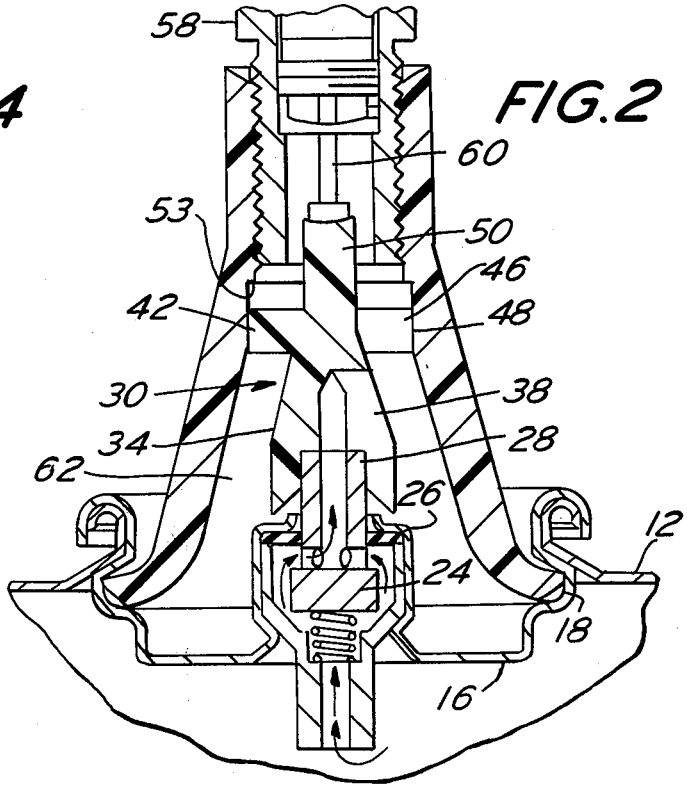

INFLATION DEVICE

BACKGROUND OF INVENTION

Inflation devices of the general type involved herein are known to those skilled in the art. For example, see U.S. Pat. Nos. 3,131,733 and 3,329,180. In each of said patents, the valve actuator is not a discrete element but rather is integrally joined with the nozzle housing. The movement of the actuator in the nozzle housings of said patents relies on the flexibility of a web. I consider the operability of such devices which rely on the flexibility of a web to be an inherent weakness. If the web is too thick, the actuator will not perform as required. Occasionally the web is improperly formed and cracked or broken which renders the device useless.

The inflation device of the present invention includes a pressurized container having a discharge valve at one end. The discharge valve includes a hollow discharge tube through which the contents of the container will be dispensed. A tubular nozzle housing is provided. The nozzle housing is open at both ends.

One end portion of the nozzle housing is secured to the container in a manner so that it circumscribes the discharge tube associated with the discharge valve. The other end portion of said nozzle housing is provided with threads on its ID. A guide bore is provided on the ID of said nozzle housing between the location of said threads and the end of said nozzle housing which is secured to said container.

A discrete actuator is provided for the discharge valve on the container. The actuator is provided with flange means reciprocably disposed in the bore of said nozzle housing. The actuator has a depending portion below the guide means and which is adapted to be aligned with the discharge tube of said discharge valve. The depending portion of said actuator is provided with a passage communicating with the discharge tube. A surface on the actuator is provided to contact and move an end face of the discharge tube. Further, the actuator has an axially disposed projection above the guide means and which is circumscribed by said threads on the nozzle housing.

The inflation device of the present invention is preferably utilized for inflating vehicle tires. Hence, the contents of the container is pressurized air. When the threads on the ID of the nozzle housing are meshed with threads on the OD of a valve stem, a pin in the valve stem contacts the actuator projection and reciprocates the same toward the container to unseat the discharge valve.

By making the actuator discrete from the nozzle housing, those two components may be manufactured more cheaply than the components as a single entity while at the same time achieving greater reliability Further, the construction of the actuator renders it usable with a hollow valve discharge tube wherein the pressurized contents discharge through the tube or in connection with a container discharge valve of the type wherein the contents discharge circumferentially about a solid pin such as that identified by numeral 44 in U.S. Pat. No. 3,329,180.

Other objects and advantages of the present invention will be apparent from the following disclosure.

For the purpose of illustrating the invention, there is shown in the drawings a form which is presently preferred; it being understood, however, that this invention is not limited to the precise arrangements and instrumentalities shown.

FIG. 1 is a vertical sectional view of an inflation device in accordance with the present invention.

FIG. 2 is a sectional view similar to FIG. 1 but showing the elements in an operative position with the nozzle connected to a valve stem.

FIG. 3 is a sectional view taken along the line 3—3 in FIG. 1.

FIG. 4 is a sectional view taken along the line 4—4 in FIG. 1.

FIG. 5 is a sectional view taken along the line 5—5 in FIG. 1.

FIG. 6 is an elevation view of the actuator.

Referring to the drawing in detail, wherein like numerals indicate like elements, there is shown in FIG. 1 an inflation device in accordance with the present invention designated generally as 10.

The inflation device 10 includes a container 12 pressurized with a fluid or liquid to be dispensed. In accordance with the preferred embodiment, the fluid is air under pressure so that the device 10 may be utilized to inflate a vehicle tire, a ball such as a basketball or football, inflatable lounging furniture, etc.

The container 12 includes a well 16 attached at its periphery to a bead 4 on the container. The well 16 is provided with a groove 18 into which is snap-fitted a bead 20 on one end of a nozzle housing 22.

The nozzle housing 22 is thusly sealed to the container 12 at one end thereof. The well 16 supports a discharge valve having a valve member 24 spring biased into contact with a valve seat 26. Compare FIGS. 1 and 2. The valve member 24 includes a hollow discharge tube 28 which is circumscribed by the nozzle housing 22. Per se, the details of the discharge valve are known to those skilled in the art and no claim with respect to novelty of the discharge valve per se is made herein.

A discrete actuator 30 is provided within the nozzle housing 22 and is adapted to move the valve member 24 to a discharge position as shown in FIG. 2.

The actuator 30 has one or more depending portions provided with a passage 32 adapted to communicate with the passage in discharge tube 28. As shown, the actuator 30 has three circumferentially disposed depending portions designated 34, 36 and 38. As shown more clearly in FIG. 4, the depending portions are equi-angularly disposed. Each of the depending portions 34, 36 and 38 has a shoulder 40 disposed radially outwardly of the passage 32 for contact with an end face on the discharge tube 28. See FIGS. 1 and 2. Thus, a portion of the depending portions 34, 36 and 38 embraces the outer periphery of the discharge tube 28. From passage 32 fluid may flow radially outwardly through the space between adjacent ones of portions 34, 36, 38 to chamber 62.

The actuator 30 includes a flange in a solid portion thereof above the passage 32. Referring to FIG. 3, actuator 30 has a flange defined by three protrusions designated 42, 44 and 46. The protrusions 42, 44 and 46 are constructed so as to converge to a point in a direction radially outwardly of the axis of the nozzle housing 22. Each of the protrusions extends radially outwardly for a greater distance than the depending portions 34, 36 and 38, and each protrusion is superimposed above one of the depending portions.

The upper end of the nozzle housing 22 which is remote from the container 12 is provided with a diameter smaller than the diameter of groove 18 and is provided with threads 52 on its ID. Between the threads 52 and the groove 18, the ID of the nozzle housing 22 is provided with a cylindrical guide bore 48. The protrusions 42, 44 and 46 have their pointed ends in contact with the guide bore 48. Due to the pointed ends of the protrusions, frictional contact with bore 48 is minimized. Further, due to the pointed shape of the protrusions, a fluid may flow from chamber 62 below the protrusions to a location above the protrusions within the nozzle housing 22.

The spring associated with the discharge valve on the housing 22 biases the valve member 24 to a closed position which in turn biases the actuator 30 to an uppermost position wherein the flange approach a circumferentially disposed shoulder 53 at the upper end of the bore 48. Shoulder 53 prevents the actuator 30 from falling out of the nozzle housing 22 when the inflation device 10 is disposed upside down. An unthreaded portion 54 is provided at the upper end of the nozzle housing 22 above the threads 52. The end face of the nozzle housing 22 is designated 56 and converges radially inwardly and downwardly.

The inflation device 10 is particularly adapted for use in connection with filling a vehicle tire having a tire valve stem 58 which internally contains a pin 60 for unseating a valve in the stem 58. The stem 58 has threads on its OD adapted to mate with the threads 52. When the tire valve stem 58 is threaded to the nozzle housing 22 as shown in FIG. 2, pin 60 contacts a concave surface on the free end of projection 50 and pushes the actuator 30 downwardly to unseat the discharge valve on the container 12. The pressurized fluid then flows through the discharge tube 28, through the passage 32 into the chamber 62, through the space between the protrusions 42–46, and then through the valve stem 58 to the vehicle tire. When the device 10 is unthreaded from the valve stem 58, the spring associated with valve member 24 biases the same upwardly in FIG. 2 thereby reciprocating the actuator 30 upwardly until it seats against shoulder 53. The bore 48 is of sufficient axial length so that the valve member 24 will be seated against valve seat 26 before the protrusions 42–46 engage the shoulder 53.

Each of the nozzle housing 22 and actuator 30 are preferably injection molded from a polymeric plastic material. Other materials may be utilized if desired. The nozzle housing 22 may include pigment so as to be colored the same as the container 12. When the container 12 is exhausted of pressurized fluid, the nozzle housing 22 is discarded along with the container 12. If desired, the nozzle housing 22 and actuator 30 may be removed and attached to a different full housing 12.

The present invention may be embodied in other specific forms without departing from the spirit or essential attributes thereof and, accordingly, reference should be made to the appended claims, rather than to the foregoing specification as indicating the scope of the invention.

I claim:

1. An inflation device comprising:

a. a container having a fluid therein under pressure, said container having a discharge valve which includes a hollow discharge tube, b. a tubular nozzle housing open at both ends, one end portion of said nozzle housing being secured to said container and circumscribing said discharge tube, the other end portion of said nozzle housing having threads on its ID, a guide bore on the ID of said nozzle housing between the location of said thread and said one end portion of said nozzle housing, c. a discrete actuator for said discharge valve, means for reciprocally disposing said actuator in said bore, said actuator having flange means in contact with said bore, said actuator having a depending portion below said flange means, said depending portions having a passage communicating with said discharge tube, said depending portion having a surface for contact with an end face of said discharge tube, and said actuator having a projection above the flange means so that the projection is circumscribed by said threads, d. means defining a flow path within said nozzle housing from said passage to said other end portion of said nozzle housing, and e. whereby external force on said projection causes said depending portions to move said discharge tube and open said discharge valve so that fluid may flow from said container through said discharge tube, passage and flow path.

2. An inflation device in accordance with claim 1 wherein said actuator has a plurality of depending portions, each depending portion having a shoulder constituting said surface for contact with the end face of said discharge tube.

3. An inflation device in accordance with claim 1 wherein said flange means includes a plurality of flanges which converge in a radially outward direction to a tip of narrow width as compared with the width of the flanges adjacent the longitudinal axis of said actuator so that the flanges cooperate with said bore to define flow passages.

4. An inflation device in accordance with claim 1 wherein said flange means comprises a plurality of discrete flanges, said depending portion including a plurality of discrete depending portions, the number of said depending portions corresponding to the number of said flanges, each flange being disposed above a discrete depending portion, and the cross section of each flange decreasing in a direction away from the longitudinal axis of said actuator.

5. An inflation device in accordance with claim 1 wherein said tubular nozzle housing is made from a polymeric plastic material, said actuator being made from a polymeric plastic material, said one end portion of said nozzle being snapfitted into a radially inwardly directed groove on said container which constitutes the sole means of securement between said nozzle housing and container.

6. An inflation device in accordance with claim 1 wherein said other end portion of said nozzle housing has a diameter which is smaller than the diameter of said one end of the nozzle housing, and said nozzle housing being uniformly tapered from said one end thereof to the location of said bore.

7. An inflation device comprising:

a. a container having a fluid therein under pressure, said container having a discharge valve, said discharge valve having a valve member, b. a tubular nozzle housing open at both ends, one end portion of said nozzle housing being secured to said container and circumscribing said discharge valve, the other end portion of said nozzle housing having a means thereon for coupling of the nozzle housing to an inflatable device, a guide bore on the ID of said nozzle housing, c. a discrete valve actuator, means for reciprocally disposing said actuator in contact with said bore, said actuator having a flange defined by a plurality of protrusions which converge in a radially outward direction to a plurality of tips of narrow width as compared to the width of the protrusions adjacent the longitudinal axis of said actuator so that the protrusions cooperate with said bore to define flow paths, said actuator having a depending portion below said flange, said depending portions having a surface for contact with an end face of said valve member, said actuator having an axial projection above the flange and circumscribed by said other end portion of said nozzle housing, d. means defining a flow path within said nozzle housing from said discharge valve to said flow paths defined by said protrusions and to said other end portion of said nozzle housing and e. whereby external force on said projection causes said depending. portion to move said valve member and open said valve member so that fluid may flow from said container through said nozzle housing to said other end portion of said nozzle housing.

* * * * *